US011131938B2

(12) United States Patent
Murayama et al.

(10) Patent No.: US 11,131,938 B2
(45) Date of Patent: Sep. 28, 2021

(54) TONER AND IMAGE FORMING METHOD

(71) Applicant: CANON KABUSHIKI KAISHA, Tokyo (JP)

(72) Inventors: Ryuji Murayama, Nagareyama (JP); Takaho Shibata, Tokyo (JP); Junichi Tamura, Toride (JP); Kenta Mitsuiki, Toride (JP); Megumi Shino, Kashiwa (JP); Hironori Minagawa, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/539,245

(22) Filed: Aug. 13, 2019

(65) Prior Publication Data

US 2020/0064751 A1 Feb. 27, 2020

(30) Foreign Application Priority Data

Aug. 23, 2018 (JP) ..... JP2018-156148

(51) Int. Cl.
*G03G 9/097* (2006.01)
*G03G 9/08* (2006.01)
*G03G 9/087* (2006.01)

(52) U.S. Cl.
CPC ..... *G03G 9/0825* (2013.01); *G03G 9/0819* (2013.01); *G03G 9/08708* (2013.01); *G03G 9/08728* (2013.01); *G03G 9/08755* (2013.01)

(58) Field of Classification Search
CPC ..... G03G 9/09708; G03G 9/09716; G03G 9/09725; G03G 9/08755; G03G 9/08711
See application file for complete search history.

(56) References Cited

U.S. PATENT DOCUMENTS

| | | | |
|---|---|---|---|
| 7,536,132 | B2 | 5/2009 | Minagawa |
| 7,833,687 | B2 | 11/2010 | Kato et al. |
| 8,697,327 | B2 | 4/2014 | Shibata et al. |
| 9,057,970 | B2 | 6/2015 | Ida et al. |
| 9,075,328 | B2 | 7/2015 | Minagawa et al. |

(Continued)

FOREIGN PATENT DOCUMENTS

JP H06-332253 12/1994

OTHER PUBLICATIONS

Diamond, Handbook of Imaging Materials, Marcel Decker, 1991.*

(Continued)

*Primary Examiner* — Peter L Vajda
(74) *Attorney, Agent, or Firm* — Venable LLP

(57) ABSTRACT

A toner comprises a toner particle including a binder resin, and inorganic fine particles A and silica particles B, wherein the inorganic fine particle A has a rectangular parallelepiped shape; an amount of the inorganic fine particles A is 0.3 to 3.0 mass parts per 100 mass parts of the toner particles; a number average particle diameter of the silica particles B is 80 to 200 nm; a fixing ratio of the inorganic fine particle A is 25% to 70%; where a separation amount of the inorganic fine particles A is denoted by YA (mg), and a separation amount of the silica particles is denoted by YB (mg), YA is 3.00 to 18.0, YA and YB satisfy the following formula, $YA/YB>0.75$, and a surface potential difference C in a rubbing test using the inorganic fine particle A and the binder resin is −70 V to +70 V.

8 Claims, 1 Drawing Sheet

(56) References Cited

U.S. PATENT DOCUMENTS

| | | | |
|---|---|---|---|
| 9,348,247 | B2 | 5/2016 | Ida et al. |
| 9,372,420 | B2 | 6/2016 | Mizo et al. |
| 9,500,975 | B2 | 11/2016 | Sugahara et al. |
| 9,540,483 | B2 | 1/2017 | Ida et al. |
| 9,599,920 | B2 | 3/2017 | Sugahara et al. |
| 9,665,021 | B2 | 5/2017 | Ohtsu et al. |
| 9,671,707 | B2 | 6/2017 | Minagawa et al. |
| 9,696,644 | B2 | 7/2017 | Ida et al. |
| 9,778,598 | B2 | 10/2017 | Onozaki et al. |
| 9,785,070 | B2 | 10/2017 | Sugahara et al. |
| 9,897,934 | B2 | 2/2018 | Tamura et al. |
| 9,958,809 | B2 | 5/2018 | Sugahara et al. |
| 9,969,834 | B2 | 5/2018 | Ohtsu et al. |
| 10,007,206 | B2 | 6/2018 | Sugahara et al. |
| 10,012,918 | B2 | 7/2018 | Ishigami et al. |
| 10,012,920 | B2 | 7/2018 | Shibata et al. |
| 10,012,921 | B2 | 7/2018 | Kamae et al. |
| 10,078,281 | B2 | 9/2018 | Ida et al. |
| 10,088,765 | B2 | 10/2018 | Miyakai et al. |
| 10,133,201 | B2 | 11/2018 | Kamae et al. |
| 10,203,619 | B2 | 2/2019 | Yamashita et al. |
| 10,216,108 | B2 | 2/2019 | Iwasaki et al. |
| 10,228,629 | B2 | 3/2019 | Tamura et al. |
| 10,234,777 | B2 | 3/2019 | Ohtsu et al. |
| 10,353,312 | B2 | 7/2019 | Kamae et al. |
| 10,409,188 | B2 | 9/2019 | Sugahara et al. |
| 10,423,090 | B2 | 9/2019 | Ohtsu et al. |
| 10,451,990 | B2 | 10/2019 | Kamae et al. |
| 2005/0058926 | A1* | 3/2005 | Kawakami ..... G03G 9/09708 430/108.7 |
| 2009/0016782 | A1* | 1/2009 | Matsuura ..... G03G 15/0818 399/286 |
| 2010/0233608 | A1* | 9/2010 | Tsurumi ..... G03G 9/107 430/108.6 |
| 2013/0108955 | A1 | 5/2013 | Shibata et al. |
| 2014/0137428 | A1 | 5/2014 | Takenaka et al. |
| 2015/0099227 | A1 | 4/2015 | Ida et al. |
| 2017/0269493 | A1* | 9/2017 | Ohtsu ..... G03G 9/08755 |
| 2018/0275540 | A1 | 9/2018 | Matsuo et al. |
| 2019/0107793 | A1 | 4/2019 | Tamura et al. |
| 2019/0339629 | A1 | 11/2019 | Yamashita et al. |

OTHER PUBLICATIONS

U.S. Appl. No. 16/526,501, Nobuyoshi Sugahara, filed Jul. 30, 2019.
U.S. Appl. No. 16/531,306, Ryuichiro Matsuo, filed Aug. 5, 2019.
U.S. Appl. No. 16/532,887, Ryuji Murayama, filed Aug. 6, 2019.
U.S. Appl. No. 16/534,343, Kentaro Kamae, filed Aug. 7, 2019.
U.S. Appl. No. 16/550,410, Masayuki Hama, filed Aug. 26, 2019.
U.S. Appl. No. 16/571,427, Nobuyoshi Sugahara, filed Sep. 16, 2019.

* cited by examiner

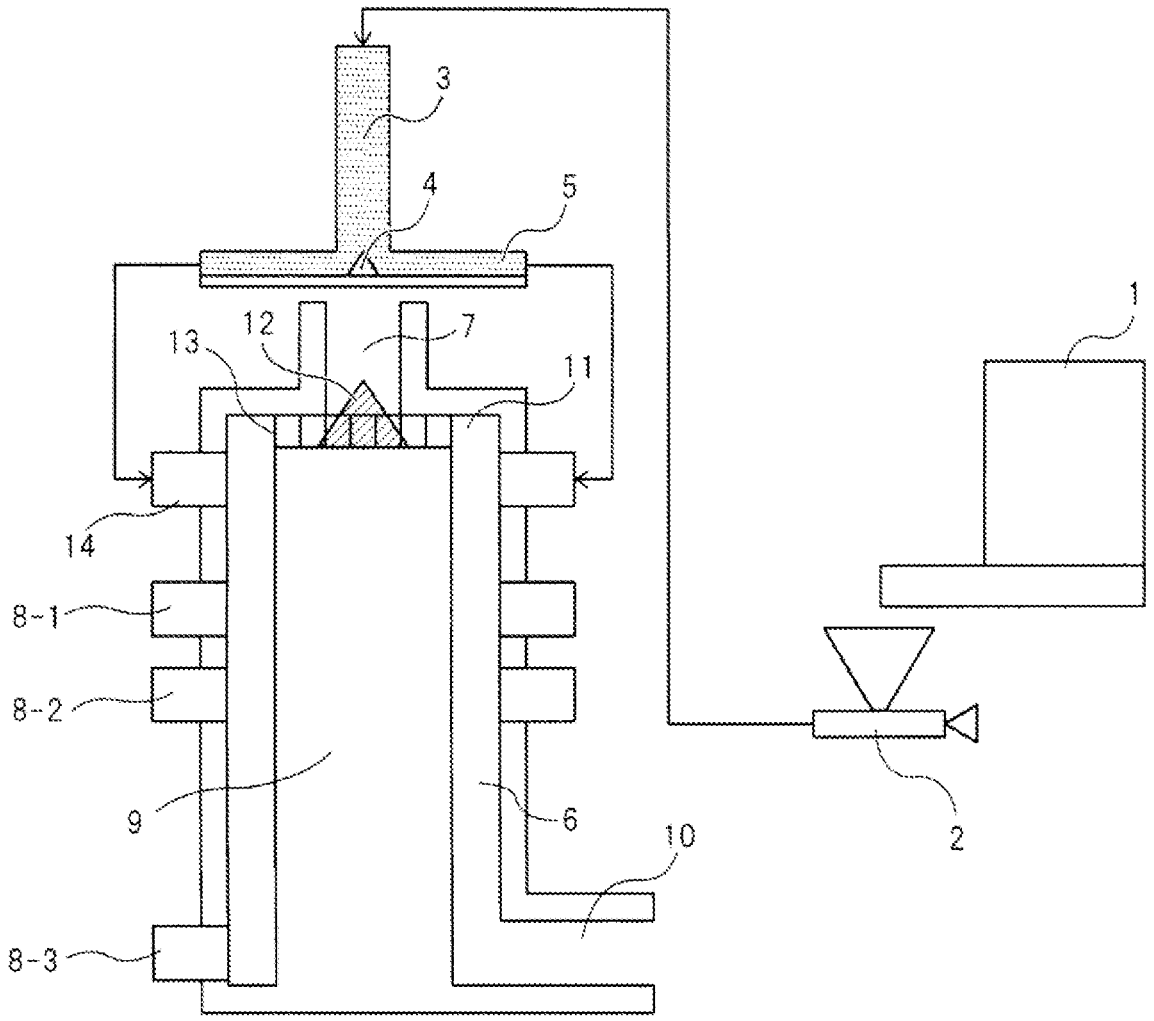
3
4
5
1
12
7
13
11
14
8-1
8-2
9
6
10
2
8-3

TONER AND IMAGE FORMING METHOD

BACKGROUND OF THE INVENTION

Field of the Invention

The present invention relates to a toner and an image forming method for use in an electrophotographic method, an electrostatic recording method, an electrostatic printing method and the like.

Description of the Related Art

Widespread usage of electrophotographic full-color copiers in recent years created a demand for stability during long-term use in addition to that for further improvement of image quality.

In order to achieve high image quality, it is essential to achieve high image reproducibility in processes such as development, transfer, and fixing. In particular, high image reproducibility can be obtained by efficiently transferring the toner developed on the electrostatic latent image bearing member in the transfer process onto an intermediate transfer member or media.

In order to obtain high transferability, it is necessary that the force of an electric field that each toner particle receives from a transfer bias be greater than the attachment force between the toner and the electrostatic latent image bearing member. The attachment force can be generally classified into a non-electrostatic attachment force represented by van der Waals force and an electrostatic attachment force represented by electrostatic reflection force.

Accordingly, JP-A-6-332253 discloses means for reducing the non-electrostatic attachment force by covering toner particles with silica particles having a large particle size in order to improve transferability.

SUMMARY OF THE INVENTION

In the toner disclosed in JP-A-6-332253, the transferability is improved, but it was found that part of the silica having a large particle diameter is transferred to the electrostatic latent image carrier, slips through the cleaning blade, and adheres to a charging roller in contact with the electrostatic latent image bearing member. It was found that this results in occurrence of a charging failure on the electrostatic latent image bearing member and causes image defects such as development of toner in the non-image area.

It follows from the above that the transferability and the charging roller contamination resistance are in a trade-off relationship, and it is urgently necessary to break out this trade-off relationship and to develop an electrophotographic toner exhibiting high image quality. That is, an object of the present invention is to provide a toner that exhibits excellent transferability and is less likely to contaminate the charging roller, and an image forming method using the toner.

As a result of intensive investigation, the inventors of the present invention have found that the charging roller is less likely to be contaminated even in the case of using silica particles having a large particle diameter when including inorganic fine particles of a rectangular parallelepiped shape in a toner and controlling the separation amount of the inorganic fine particles per 1 g of the toner within a specific range. It is thought that such an operational effect is obtained because even when silica having a large particle diameter adheres to the charging roller, where a certain amount of inorganic fine particles of a rectangular parallelepiped shape is conveyed to the charging roller, the inorganic fine particles have an effect of scraping the silica particles off the charging roller. That is, it is possible to reduce the charging roller contamination while maintaining a low non-electrostatic attachment force of the toner.

However, the transferability was not improved only by the above configuration. This is apparently because the electrostatic attachment force is increased by the local charge generation on the surface of the toner particle due to triboelectric charging of the toner and the inorganic fine particles transferred to the carrier.

As a result of further studies, the inventors of the present invention have found that it is possible to solve the above-mentioned problems by making the triboelectric series of rectangular parallelepiped fine particles equal to that of a binder resin.

That is, the toner of the present invention comprises a toner particle including a binder resin, and an inorganic fine particle A and a silica particle B, wherein the inorganic fine particle A has a rectangular parallelepiped particle shape;

an amount of the inorganic fine particle A is from 0.3 parts by mass to 3.0 parts by mass with respect to 100 parts by mass of the toner particle;

a number average particle diameter of primary particles of the silica particle B is 80 nm to 200 nm;

a fixing ratio of the inorganic fine particle A to the toner particle is 25% to 70%; and wherein when preparing a toner dispersion of which the toner is dispersed in an aqueous sucrose solution, and centrifuging the dispersion, a separation amount of the inorganic fine particle A per 1 g of the toner is denoted by YA (mg) and a separation amount of the silica particle B per 1 g of the toner is denoted by YB (mg), YA is 3.00 to 18.0, YA and YB satisfy a following formula (1), $$YA/YB > 0.75 \quad (1), \text{ and}$$

a surface potential difference C in a rubbing test performed using the inorganic fine particle A and the binder resin is −70 V to +70 V, wherein the surface potential difference C=(surface potential D of a resin piece of the binder resin measured in a state in which the inorganic fine particle A adheres to the resin piece after rubbing the resin piece and the inorganic fine particle A together)−(surface potential E measured using a resin piece of the binder resin obtained by removing the inorganic fine particle A by air blow after rubbing the resin piece and the inorganic fine particle A together).

According to the present invention, it is possible to provide a toner that exhibits excellent transferability and is less likely to contaminate the charging roller, and an image forming method using the toner.

Further features of the present invention will become apparent from the following description of exemplary embodiments with reference to the attached drawings.

BRIEF DESCRIPTION OF THE DRAWINGS

The FIGURE is a schematic view of a surface treatment apparatus.

DESCRIPTION OF THE EMBODIMENTS

In the present invention, the descriptions of "from XX to YY" and "XX to YY" representing a numerical range mean a numerical range including the lower limit and the upper limit which are end points, unless specifically stated otherwise.

The toner of the present invention comprises a toner particle including a binder resin, and an inorganic fine particle A and a silica particle B, wherein the inorganic fine particle A has a rectangular parallelepiped particle shape;

an amount of the inorganic fine particle A is from 0.3 parts by mass to 3.0 parts by mass with respect to 100 parts by mass of the toner particle;

a number average particle diameter of primary particles of the silica particle B is 80 nm to 200 nm;

a fixing ratio of the inorganic fine particle A to the toner particle is 25% to 70%; and wherein when preparing a toner dispersion of which the toner is dispersed in an aqueous sucrose solution, and centrifuging the dispersion, a separation amount of the inorganic fine particle A per 1 g of the toner is denoted by YA (mg) and a separation amount of the silica particle B per 1 g of the toner is denoted by YB (mg), YA is 3.00 to 18.0, YA and YB satisfy a following formula (1), $$YA/YB>0.75 \quad (1), \text{ and}$$

a surface potential difference C in a rubbing test performed using the inorganic fine particle A and the binder resin is −70 V to +70 V, wherein the surface potential difference C=(surface potential D of a resin piece of the binder resin measured in a state in which the inorganic fine particle A adheres to the resin piece after rubbing the resin piece and the inorganic fine particle A together)−(surface potential E measured using a resin piece of the binder resin obtained by removing the inorganic fine particle A by air blow after rubbing the resin piece and the inorganic fine particle A together).

As described above, the toner as disclosed in JP-A-6-332253 has room for improvement in terms of preventing the contamination of the charging roller, and it is difficult to improve also the transferability by only including a large amount of solid inorganic fine particles having a rectangular parallelepiped shape.

Accordingly, the inventors of the present invention have found that both the transferability and the charging roller contamination resistance can be improved by controlling the fixing ratio of the inorganic fine particles to the toner particle and making the triboelectric series of the inorganic fine particles equal to that of the binder resin.

The fixing ratio of the inorganic fine particles A and the silica fine particles B and the separation amount of an external additive can be measured by the following method.

A total of 160 g of sucrose (manufactured by Kishida Chemical Co., Ltd.) is added to 100 mL of ion exchanged water and dissolved while heating in water to prepare a concentrated sucrose aqueous solution. A total of 31 g of the above concentrated sucrose aqueous solution and 6 mL of Contaminon N (10% by mass aqueous solution of neutral detergent having pH 7 and including a non-ionic surfactant, an anionic surfactant, and an organic builder; for cleaning precision instruments; manufactured by Wako Pure Chemical Industries, Ltd.) are placed in a 20 mL glass bottle to prepare a dispersion. A total of 1.0 g of the toner is added to this dispersion, and a lump of toner is loosened with a spatula or the like.

The glass bottle including the sample is shaken with a Yayoi shaker at 200 rpm for 5 min. After shaking, the solution is transferred to a glass tube for a swing rotor (50 mL), and separated with a centrifuge operation under conditions of 3500 rpm and 30 min. By this operation, the toner particles and the detached external additive are separated. Sufficient separation of the toner layer and the aqueous layer is visually confirmed, and the toner in the uppermost layer (interface part with the aqueous layer) of the toner layer is collected with a spatula or the like. The collected toner is filtered with a vacuum filter, and then dried with a drier for 1 h or more to obtain toner particles from which the external additive has been separated.

The fixing ratio of the inorganic fine particles A is measured in the following manner. First, the inorganic fine particles A contained in the toner before the separation step are quantified. In this method, the metal element intensity: MB in the toner particle is measured using a wavelength dispersive fluorescent X-ray analyzer Axios advanced (manufactured by PANalytical). The metal element that becomes the object of measurement varies depending on the composition of the inorganic fine particles A. For example, the metal element is Ti for titanium oxide, Sr for strontium titanate, and Si for silica. Next, the metal element intensity: MA of the toner after the above separation step is measured in the same manner.

The fixing ratio is determined by (MA/MB)×100(%).

Further, the separation amounts YA and YB are measured using MA and MB measured when measuring the fixing ratio, and the amounts (NA and NB) of the inorganic fine particles A and the silica particles B added to 1 g of the toner.

The separation amount YA is determined by ((MB)−(MA))×NA/(MB), and the separation amount YB is determined by ((MB)−(MA))×NB/(MB).

The fixing ratio of the inorganic fine particles A to the toner particles is 25% to 70%. Where the fixing ratio is less than 25%, the amount of the inorganic fine particles A of the toner is reduced, the resistance of the toner particle surface is increased, the local charge is increased, the electrostatic attachment force is increased due to increased local charging, and the transferability is reduced. Where the fixing ratio is higher than 70%, the amount of the inorganic fine particles A supplied to the charging roller is small, so the charging roller is easily contaminated.

The fixing ratio of the inorganic fine particles A is preferably 40% to 60%. The fixing ratio of the inorganic fine particles A can be controlled by a method such as changing the revolution speed and revolution time when the inorganic fine particles A are coated on the toner particle with a mixer or the like.

Further, where the separation amount of the inorganic fine particles A per 1 g of the toner is denoted by YA (mg) and the separation amount of the silica particles B per 1 g of the toner is denoted by YB (mg), YA is 3.00 to 18.0. When YA is more than 18.0, the amount of the inorganic fine particles A in the toner decreases, so that the resistance of the surface of the toner particles increases, the reflection force increases, the electrostatic attraction force increases, and the transferability decreases. When YA is less than 3.00, the charging roller is likely to be contaminated.

YA is preferably 5.00 to 15.0. YA can be controlled by a method such as changing the revolution speed and revolution time when the inorganic fine particles A are coated on the toner particle with a mixer or the like.

YB is preferably 1.00 to 7.00, and is more preferably 2.00 to 6.00.

Further, YA and YB satisfy the relationship represented by the following formula (1).

$$YA/YB>0.75 \quad (1)$$

When YA/YB is 0.75 or less, the amount of the silica particles B migrated to the charging roller increases with respect to that of the inorganic fine particles A, and the charging roller is easily contaminated. From the viewpoint of suppressing the charging roller contamination, it is preferable that YA and YB satisfy the relationship represented by the following formula (1').

$$YA/YB>1.20 \quad (1')$$

The upper limit of YA/YB is not particularly limited, but is preferably 3.00 or less and more preferably 2.50 or less. YA/YB can be controlled by a method such as changing the revolution speed and revolution time when the silica particles B are coated on the toner particle with a mixer or the like. Each of YA and YB can be controlled by adding the inorganic fine particles A and the silica particles B on the toner particle stepwisely, and changing addition sequence, revolution speed and revolution time thereof.

The amount of the inorganic fine particles A is from 0.3 parts by mass to 3.0 parts by mass with respect to 100 parts by mass of the toner particles. Preferably, this amount is from 0.8 parts by mass to 1.5 parts by mass.

Where the amount is less than 0.3 parts by mass, the amount of the inorganic fine particles A supplied to the charging roller is reduced, so the charging roller is easily contaminated. Meanwhile, when the amount is more than 3.0 parts by mass, the low-temperature fixability is lowered.

The inorganic fine particles A are not particularly limited as long as they can be produced in a rectangular parallelepiped shape, but titanates are preferable because they have low volume resistance and can be easily controlled to a cubic shape.

Although a known method can be used to prepare the inorganic fine particles A having a rectangular parallelepiped shape, a cubic titanate can be manufactured by the following atmospheric-pressure heating reaction method.

A mineral acid peptized product of a hydrolyzate of a titanium compound is used as a titanium oxide source. Preferably, metatitanic acid having an $SO_3$ amount of 1.0% by mass or less, more preferably 0.5% by mass or less and obtained by a sulfuric acid method is adjusted to a pH of from 0.8 to 1.5 with hydrochloric acid and peptized.

Meanwhile, a metal nitrate or chloride can be used as a metal source other than titanium.

As the nitrate, for example, strontium nitrate, magnesium nitrate, calcium nitrate, potassium nitrate and the like can be used. As the chloride, for example, strontium chloride, magnesium chloride, calcium chloride, potassium chloride and the like can be used.

Among these, when a nitrate or chloride of strontium, calcium, or magnesium, is used in the manufacturing process, the obtained metal titanate particles have a perovskite crystal structure, which is preferable in that the environmental stability of charging is further improved.

As the aqueous alkali solution, a caustic alkali can be used, and among them, an aqueous solution of sodium hydroxide is preferable.

The inorganic fine particles A preferably include at least one selected from the group consisting of strontium titanate particles, calcium titanate particles, and magnesium titanate particles. The inorganic fine particles A more preferably include strontium titanate particles, and even more preferably are strontium titanate particles.

The triboelectric series of the binder resin and the inorganic fine particles A can be confirmed by the following method.

The triboelectric series is determined by the fact that when two objects are rubbed together, one is charged positively and the other is charged negatively. Therefore, the triboelectric series of the binder resin and the external additive can be derived by the following rubbing test.

First, a resin piece is prepared using a binder resin. The method for producing the resin piece can be implemented, for example, in the following manner. On a hot plate heated to a temperature higher than the softening point of the resin (preferably the softening point of the binder resin+20° C., for example, 110° C. for a polyester resin), the binder resin is sandwiched between 40 μm-thick PTFE sheets, and a pressure is applied thereto with a flat member such as a hammer to prepare the resin piece. The dimensions of the resin piece are about 1 cm long, 2 cm wide and 1 mm high.

Next, an electric charge is removed from the surface of the prepared resin piece by a discharging device. The charge is removed by irradiating with a weak X-ray (tube voltage: 15 kV, irradiation angle: 130°) for 30 sec with an X-ray generator (Photoionizer manufactured by Hamamatsu Photonics Co., Ltd.).

It is confirmed that no potential remains on the resin piece when the potential measured with a surface potentiometer is −70 V to +70 V (model 347 manufactured by Trek Japan Co.). Here, the distance between the surface potentiometer and the resin piece is 1 cm.

Next, the inorganic fine particle A is placed on the resin piece, and the inorganic fine particle A is sandwiched between this resin piece and another similarly produced resin piece and rubbed back and forth for 30 cycles.

Here, the surface potential of the resin piece measured in a state in which the inorganic fine particle A adheres to the resin piece is taken as a surface potential D.

The surface potential measured using a resin piece obtained by removing the inorganic fine particle A by air blow so that this external additive does not generate triboelectric charging is taken as surface potential E.

By calculating the difference between the surface potential D and the surface potential E, it is possible to calculate the amount of potential held by the inorganic fine particle A.

That is, the triboelectric series of the binder resin and the inorganic fine particles A can be calculated by the following equation.

The surface potential difference C=(surface potential D of the resin piece of the binder resin measured in a state in which the inorganic fine particle A adheres to the resin piece after rubbing the resin piece and the inorganic fine particle A together)−(surface potential E measured using the resin piece of the binder resin obtained by removing the inorganic fine particle A by air blow after rubbing the resin piece and the inorganic fine particle A together).

The surface potential difference C needs to be in the range of −70V to +70V. Within this range, the inorganic fine particles A and the toner particles transferred to the carrier do not show local charging, so it is possible to suppress the decrease in transferability accompanying the increase in electrostatic attachment force. The surface potential difference C is preferably −50V to +50V.

The surface potential difference C can be controlled, for example, by surface treatment of the inorganic fine particle A. The transferability is improved by selecting a surface treatment agent such that the surface potential difference C obtained by the rubbing test of the binder resin and the inorganic fine particle A is in the above range.

The surface treatment agent of the inorganic fine particle A is not particularly limited, and examples thereof include disilylamine compounds, halogenated silane compounds, silicone compounds, fatty acids, fatty acid metal salts, silane coupling agents, fluorine-containing silane coupling agents and the like.

The disilylamine compound is a compound having a disilylamine (Si—N—Si) segment. Examples of disilylamine compounds include hexamethyldisilazane (HMDS), N-methyl-hexamethyldisilazane or hexamethyl-N-propyldisilazane. An example of a halogenated silane compound is dimethyldichlorosilane.

Examples of silicone compounds include silicone oils and silicone resins (varnishes). Examples of silicone oils include dimethyl silicone oil, methyl phenyl silicone oil, silicone oil modified with α-methyl styrene, chlorophenyl silicone oil and silicone oil modified with fluorine. Examples of the silicone resins (varnishes) include methyl silicone varnish and phenyl methyl silicone varnish.

Examples of silane coupling agents include silane coupling agents having an alkyl group and an alkoxy group, and silane coupling agents having an amino group and an alkoxy group.

More specific examples of silane coupling agents and fluorine-containing silane coupling agents include dimethyldimethoxysilane, dimethyldiethoxysilane, diethyldimethoxysilane, diethyldiethoxysilane, trimethylmethoxysilane, trimethyldiethoxysilane, triethylmethoxysilane, triethyldiethoxysilane, γ-glycidoxypropyltrimethoxysilane, γ-chloropropyltrimethoxysilane, γ-aminopropyltrimethoxysilane, γ-aminopropyltriethoxysilane, γ-aminopropyl dimethoxymethyl silane or γ-aminopropyldiethoxymethylsilane, 3,3,3-trifluoropropyldimethoxysilane, 3,3,3-trifluoropropyldiethoxysilane, perfluorooctylethyltriethoxysilane, 1,1,1-trifluorohexyldiethoxysilane and the like.

Examples of fatty acids and fatty acid metal salts include zinc stearate, sodium stearate, calcium stearate, zinc laurate, aluminum stearate, magnesium stearate, and the like. It is also possible to use stearic acid which is a fatty acid.

The surface treatment agents described above may be used singly or in combination of two or more types thereof.

The number average particle diameter of the inorganic fine particles A is preferably 10 nm to 60 nm, and more preferably 10 nm to 40 nm. When the particle diameter is 60 nm or less, the amount of the inorganic fine particles A slipping through the cleaning blade transferred onto the electrostatic latent image bearing member increases, so the charging roller is less likely to be contaminated.

The amount of the silica particles B is preferably from 0.5 parts by mass to 10.0 parts by mass, and more preferably from 2.0 parts by mass to 10.0 parts by mass with respect to 100 parts by mass of the toner particles. When the amount is 0.5 parts by mass or more, the non-electrostatic attachment force is lowered, the transferability is improved, and the amount is more preferably 2.0 parts by mass or more. When the amount is 10.0 parts by mass or less, the low temperature fixability is improved, and the amount is more preferably 5.0 parts by mass or less.

The number average particle diameter of primary particles of the silica particles B is 80 nm to 200 nm. Preferably, this diameter is 100 nm to 140 nm.

Binder Resin

The toner particle includes a binder resin. The following polymers can be used as the binder resin.

Homopolymer of styrene and substitution products thereof such as polystyrene, poly-p-chlorostyrene, polyvinyl toluene, and the like; styrene-(meth)acrylic copolymer resins such as styrene-p-chlorostyrene copolymer, styrene-vinyl toluene copolymer, styrene-vinyl naphthalene copolymer, styrene-acrylic acid ester copolymers, styrene-methacrylic acid ester copolymers, and the like; polyester resins and hybrid resins obtained by mixing or partially reacting a polyester resin and a styrene-(meth)acrylic copolymer resin; polyvinyl chloride, phenolic resins, natural resin-modified phenolic resins, natural resin-modified maleic resins, acrylic resins, methacrylic resins, polyvinyl acetate, silicone resins, polyester resins, polyurethane resins, polyamide resins, furan resins, epoxy resins, xylene resins, polyethylene resins, polypropylene resins and the like.

Among them, polyester resins, styrene-(meth)acrylic copolymer resins, and hybrid resin in which a polyester resin and a styrene-(meth)acrylic copolymer resin are bonded (for example, covalently bonded) are preferable. The binder resin preferably includes a polyester resin, and from the viewpoint of low-temperature fixability, it is preferable that a polyester resin be a main component. The main component means that the amount thereof is 50% by mass to 100% by mass (preferably 80% by mass to 100% by mass).

As a monomer to be used for the polyester unit of a polyester resin, polyhydric alcohol (dihydric, trihydric or higher alcohol), polyvalent carboxylic acid (divalent, trivalent or higher carboxylic acid), acid anhydrides thereof or lower alkyl esters thereof are used. Here, it is preferable to induce partial crosslinking in the molecule of the amorphous resin in order to create a branched polymer so as to develop "strain curability". For that purpose, it is preferable to use a trivalent or higher polyfunctional compound. Therefore, it is preferable to include, as a raw material monomer of the polyester unit, a trivalent or higher carboxylic acid, an acid anhydride thereof or a lower alkyl ester thereof, and/or a trihydric or higher alcohol.

The following polyhydric alcohol monomers can be used as a polyhydric alcohol monomer for the polyester unit of the polyester resin.

Examples of the dihydric alcohol component include ethylene glycol, propylene glycol, 1,3-butanediol, 1,4-butanediol, 2,3-butanediol, diethylene glycol, triethylene glycol, 1,5-pentanediol, 6-hexanediol, neopentyl glycol, 2-ethyl-1,3-hexanediol, hydrogenated bisphenol A, bisphenol represented by formula (A) and derivatives thereof.

(A)

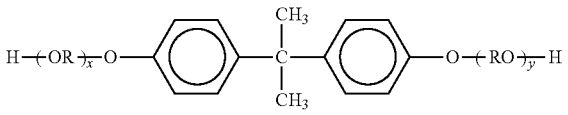

(in the formula, R is ethylene or propylene, x and y are each an integer of 0 or more, and the average value of x+y is from 0 to 10).

Diols represented by formula (B) can be mentioned.

(B)

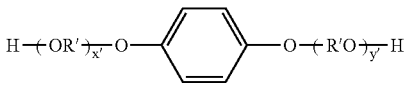

(in the formula, R' is

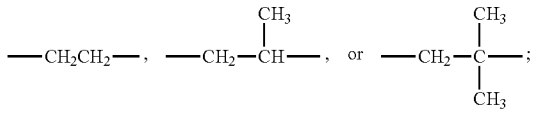

x' and y' are each an integer of 0 or more; and the average value of x'+y' is 0 to 10).

Examples of the trivalent or higher alcohol component include sorbitol, 1,2,3,6-hexanetetrol, 1,4-sorbitan, pentaerythritol, dipentaerythritol, tripentaerythritol, and 1,2,4-butanetriol. 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Among these, glycerol, trimethylolpropane and pentaerythritol are preferably used. These dihydric alcohols and trihydric or higher alcohols may be used singly or in combination of a plurality thereof.

The following polyvalent carboxylic acid monomers can be used as a polyvalent carboxylic acid monomer used for the polyester unit of the polyester resin.

Examples of the divalent carboxylic acid component include maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, anhydrides of these acids, lower alkyl esters thereof and the like. Among these, maleic acid, fumaric acid, terephthalic acid and n-dodecenyl succinic acid are preferably used.

Examples of the trivalent or higher carboxylic acid, acid anhydrides thereof and lower alkyl esters thereof include 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, Empol trimer acid, acid anhydrides thereof and lower alkyl esters thereof.

Among these, 1,2,4-benzenetricarboxylic acid, that is, trimellitic acid or a derivative thereof is particularly preferably used because it is inexpensive and the reaction control is easy. These divalent carboxylic acids and the like and trivalent or higher carboxylic acids can be used alone or in combination of a plurality thereof.

A method for producing the polyester resin is not particularly limited, and known methods can be used. For example, the above-mentioned alcohol monomer and carboxylic acid monomer are simultaneously charged and polymerized through an esterification reaction or a transesterification reaction and a condensation reaction to produce a polyester resin. The polymerization temperature is not particularly limited, but is preferably in the range of from 180° C. to 290° C. In the polymerization of the polyester resin, for example, a polymerization catalyst such as a titanium-based catalyst, a tin-based catalyst, zinc acetate, antimony trioxide, germanium dioxide or the like can be used. In particular, the binder resin is more preferably a polyester resin polymerized using a tin-based catalyst.

The acid value of the polyester resin is preferably from 5 mg KOH/g to 20 mg KOH/g, and the hydroxyl value is preferably from 20 mg KOH/g to 70 mg KOH/g. Within the above ranges, the amount of adsorbed moisture under a high-temperature and high-humidity environment can be suppressed and the non-electrostatic attachment force can be suppressed to a low level, which is preferable from the viewpoint of suppressing fogging.

The binder resin may be used by mixing a low molecular weight resin and a high molecular weight resin. From the viewpoint of low-temperature fixability and hot offset resistance, the content ratio of the high molecular weight resin and the low molecular weight resin is preferably from 40/60 to 85/15 on a mass basis.

The binder resin and the inorganic fine particles A are preferably used in the following combination.

An embodiment in which the inorganic fine particles A are surface-treated with at least one selected from the group consisting of a silane coupling agent and a fluorine-containing silane coupling agent, and the binder resin is a polyester resin.

An embodiment in which the inorganic fine particles A are surface-treated with at least one selected from the group consisting of a fatty acid and a fatty acid metal salt, and the binder resin is a styrene-(meth)acrylic copolymer resin.

An embodiment in which the inorganic fine particles A are surface-treated with at least one selected from the group consisting of a silane coupling agent, a fluorine-containing silane coupling agent, a fatty acid and a fatty acid metal salt, and the binder resin is a hybrid resin in which a polyester resin and a styrene-(meth)acrylic-type copolymer resin are bonded together.

Release Agent

Wax may be used for the toner particle. Examples of the wax include the following.

Hydrocarbon waxes such as low molecular weight polyethylene, low molecular weight polypropylene, alkylene copolymers, microcrystalline wax, paraffin wax, and Fischer-Tropsch wax; oxides of hydrocarbon waxes such as oxidized polyethylene wax or block copolymers thereof; waxes based on fatty acid esters such as carnauba wax; partially or entirely deoxidized fatty acid esters such as deoxidized carnauba wax. Further, the following may be mentioned.

Saturated linear fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol, and melissyl alcohol; polyhydric alcohols such as sorbitol; esters of fatty acids such as palmitic acid, stearic acid, behenic acid, and montanic acid with alcohols such as stearyl alcohol, aralkyl alcohol, behenyl alcohol, carnaubyl alcohol, ceryl alcohol, and melissyl alcohol; fatty acid amides such as linoleic acid amide, oleic acid amide, and lauric acid amide; saturated fatty acid bisamides such as methylene bis(stearic acid amide), ethylene bis(capric acid amide), ethylene bis(lauric acid amide), and hexamethylene bis(stearic acid amide); unsaturated fatty acid amides such as ethylene bis(oleic acid amide), hexamethylene bis(oleic acid amide), N,N'-dioleyl adipic acid amide, and N,N'-dioleyl sebacic acid amide; aromatic bisamides such as m-xylene bis(stearic acid amide) and N,N'-distearyl isophthalic acid amide; aliphatic metal salts such as calcium stearate, calcium laurate, zinc stearate, and magnesium stearate (generally referred to as metal soaps); waxes obtained by grafting aliphatic hydrocarbon waxes by using vinyl monomers such as styrene and acrylic acid; partial esterification products of fatty acids with polyhydric alcohols such as monoglyceride behenate; and methyl ester compounds having a hydroxyl group which are obtained by hydrogenation of vegetable fats and oils.

Among these waxes, from the viewpoint of improving low-temperature fixability and fixation separability, hydrocarbon waxes such as paraffin wax and Fischer-Tropsch wax, and fatty acid ester waxes such as carnauba wax are preferable. Hydrocarbon waxes are more preferable in that the hot offset resistance is further improved.

The wax is preferably used in an amount of 3 parts by mass to 8 parts by mass with respect to 100 parts by mass of the binder resin.

Further, in the endothermic curve at the time of temperature rise measured with a differential scanning calorimetry (DSC) device, the peak temperature of the maximum endothermic peak of the wax is preferably from 45° C. to 140° C. This range of the peak temperature of the maximum endothermic peak of the wax is preferable because both the storage stability of the toner and the hot offset resistance can be achieved.

Colorant

The toner particle may include a colorant. Examples of the colorant are presented hereinbelow.

Examples of black colorants include carbon black and those adjusted to black color by using yellow colorants, magenta colorants and cyan colorants. Although a pigment may be used alone as the colorant, from the viewpoint of image quality of a full color image, it is more preferable to improve the sharpness by using a dye and a pigment in combination.

Examples of pigments for a magenta toner are presented hereinbelow. C. I. Pigment Red 1, 2, 3, 4, 5, 6, 7, 8, 9, 10, 11, 12, 13, 14, 15, 16, 17, 18, 19, 21, 22, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, 282; C. I. Pigment Violet 19; C. I. Vat Red 1, 2, 10, 13, 15, 23, 29, 35.

Examples of dyes for a magenta toner are presented hereinbelow. C. I. Solvent Red 1, 3, 8, 23, 24, 25, 27, 30, 49, 81, 82, 83, 84, 100, 109, 121; C. I. Disperse Red 9; C. I. Solvent Violet 8, 13, 14, 21, 27; oil-soluble dyes such as C. I. Disperse Violet 1, C. I. Basic Red 1, 2, 9, 12, 13, 14, 15, 17, 18, 22, 23, 24, 27, 29, 32, 34, 35, 36, 37, 38, 39, 40; and basic dyes such as C. I. Basic Violet 1, 3, 7, 10, 14, 15, 21, 25, 26, 27, 28.

Examples of pigments for a cyan toner are presented hereinbelow. C. I. Pigment Blue 2, 3, 15:2, 15:3, 15:4, 16, 17; C. I. Vat Blue 6; C. I. Acid Blue 45, and copper phthalocyanine pigments having a phthalocyanine skeleton substituted with 1 to 5 phthalimidomethyl groups.

Dyes for a cyan toner are exemplified by C. I. Solvent Blue 70.

Examples of pigments for a yellow toner are presented hereinbelow. C. I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, 185; C. I. Vat Yellow 1, 3, 20.

Dyes for a yellow toner are exemplified by C. I. Solvent Yellow 162.

These colorants can be used singly or in a mixture, or in the form of a solid solution. The colorant is selected in consideration of hue angle, saturation, lightness, light resistance, OHP transparency, and dispersibility in toner particle.

The content of the colorant is preferably 0.1 parts by mass to 30.0 parts by mass with respect to 100 parts by mass of the binder resin.

Inorganic Fine Particles

The toner includes the inorganic fine particles A having a rectangular parallelepiped shape and the silica particles B. Moreover, the toner may include, as needed, fine particles of two or more types corresponding to the inorganic fine particles A, and the silica particles B. The rectangular parallelepiped particle shape is inclusive of a cuboid particle shape, and the cuboid and rectangular parallelepiped shapes are not limited to perfect cube and rectangular parallelepiped and are inclusive of a substantially cube and a substantially rectangular parallelepiped, for example chipped or roundish cube or rectangular parallelepiped. Further, the aspect ratio of the inorganic fine particles A is preferably from 1.0 to 3.0.

The inorganic fine particles may be internally added to the toner particle or may be mixed with the toner particle as an external additive, but the design needs to be such that the fixing ratio of the inorganic fine particles A is 25% to 70%.

External additives other than the inorganic fine particles A and the silica particles B may be used to the extent that the effects of the present invention are not impaired. As the external additive other than the inorganic fine particles A and the silica particles B, inorganic fine particles such as titanium oxide and aluminum oxide are preferable. In particular, external additives with low resistance, such as titanium oxide and strontium titanate, are preferable from the viewpoint of fogging and transfer efficiency because changes in the charge quantity due to temperature and humidity environments can be suppressed, localization of the charge of the toner is suppressed, and the electrostatic attachment force is reduced. The inorganic fine particles are preferably hydrophobized with a hydrophobizing agent such as a silane compound, silicone oil or a mixture thereof.

A known mixer such as a Henschel mixer can be used to mix the toner particles with the external additive.

Developer

The toner can be used as a one-component developer, but can also be used as a two-component developer in a mixture with a magnetic carrier in order to suppress charge localization on the toner particle surface.

Magnetic carriers include generally known materials such as, for example, iron oxide; metal particles such as iron, lithium, calcium, magnesium, nickel, copper, zinc, cobalt, manganese, chromium and rare earths, alloy particles thereof, and oxide particles thereof; magnetic bodies such as ferrites; magnetic body-dispersed resin carriers (the so-called resin carriers) including a binder resin in which the magnetic bodies are held in a dispersed state; and the like.

When the toner is mixed with a magnetic carrier and used as a two-component developer, the mixing ratio of the magnetic carrier at that time is preferably from 2% by mass to 15% by mass, and more preferably 4% by mass to 13% by mass as the toner concentration in the two-component developer.

Method for Producing Toner

The method for producing toner particles is not particularly limited, and a known suspension polymerization method, dissolution suspension method, emulsion aggregation method and pulverization method can be adopted.

Hereinafter, the toner production procedure in the pulverization method will be described.

In a raw material mixing step, for example, a binder resin and, if necessary, other components such as a release agent, a colorant, and a charge control agent are weighed in predetermined amounts, compounded and mixed as materials constituting toner particles. Examples of the mixing apparatus include a double-cone mixer, a V-type mixer, a drum mixer, a super mixer, a Henschel mixer, a NAUTA mixer, and a MECHANO HYBRID (manufactured by Nippon Coke Industry Co., Ltd.).

Next, the mixed materials are melt-kneaded to disperse the materials in the binder resin. In the melt-kneading process, a batch-type kneader such as a pressure kneader or a Banbury mixer, or a continuous-type kneader can be used, and a single- or twin-screw extruder is mainly used because of its superiority of continuous production.

Specific examples include a KTK type twin-screw extruder (manufactured by Kobe Steel, Ltd.), a TEM type twin-screw extruder (manufactured by Toshiba Machine Co., Ltd.), a PCM kneader (made by Ikegai Corp.), a twin-screw extruder (manufactured by KCK Co.), Co-Kneader (manufactured by Buss AG) and KNEADEX (manufactured by Nippon Coke & Engineering Co., Ltd.). Furthermore, the resin composition obtained by melt-kneading may be rolled with a two-roll mill or the like, and may be cooled with water or the like in the cooling step.

The cooled resin composition is then pulverized to the desired particle size in the pulverization step. In the pulverization step, coarse pulverization is performed with a pulverizing device such as, for example, a crusher, a hammer mill, or a feather mill. Thereafter, for example, the material is finely pulverized by a KRYPTON system (manufactured by Kawasaki Heavy Industries, Ltd.), SUPER ROTOR (manufactured by Nisshin Engineering Co., Ltd.), TURBO MILL (manufactured by Turbo Kogyo) or an air jet type fine pulverizing device.

After that, if necessary, classification is performed using a classifier or sieving machine such as ELBOW JET (manufactured by Nittetsu Mining Co., Ltd.) of an inertial classification type, TURBOPLEX (manufactured by Hosokawa Micron Corporation) of a centrifugal classification type, TSP Separator (manufactured by Hosokawa Micron Corporation), or FACULTY (manufactured by Hosokawa Micron Corporation).

Thereafter, surface treatment of the toner particles by heating may be performed if necessary. The circularity of the toner can thus be increased. For example, surface treatment can be performed by hot air by using the surface treatment apparatus shown in the FIGURE.

A mixture quantitatively supplied by a raw material quantitative supply means 1 is introduced to an introduction pipe 3 installed on the vertical line of the raw material supply means by a compressed gas adjusted by a compressed gas adjustment means 2. The mixture that has passed through the introduction pipe is uniformly dispersed by a conical projection-shaped member 4 provided at the central portion of the raw material supply means, and is introduced into the radially extending eight-direction supply pipes 5 to be introduced into a treatment chamber 6 where the heat treatment is performed.

At this time, the flow of the mixture supplied to the treatment chamber is regulated by a regulation means 9 provided in the treatment chamber for regulating the flow of the mixture. For this reason, the mixture supplied to the treatment chamber is cooled after being heat-treated while swirling in the treatment chamber.

Hot air for heat-treating the supplied mixture is supplied from the hot air supply means 7, and is swirled and introduced into the treatment chamber by a swirling member 13 for swirling the hot air. As a specific configuration, the swirling member 13 for swirling the hot air may have a plurality of blades, and the swirling of the hot air can be controlled by the number and angle of the blades. The temperature of the hot air supplied into the treatment chamber at the outlet of the hot air supply means 7 is preferably 100° C. to 300° C. Where the temperature at the outlet of the hot air supply means is within the above range, the toner particles can be uniformly spheroidized while preventing fusion or coalescence of the toner particles due to excessive heating of the mixture.

Further, the heat-treated toner particles subjected to the heat treatment are cooled by the cold air supplied from a cold air supply means 8 (8-1, 8-2, 8-3), and the temperature supplied from the cold air supply means 8 is preferably −20° C. to 30° C. Where the temperature of the cold air is within the above range, the heat-treated toner particles can be efficiently cooled, and fusion or coalescence of the heat-treated toner particles can be prevented without inhibiting uniform spheroidization of the mixture. The absolute moisture content of the cold air is preferably from 0.5 $g/m^3$ to 15.0 $g/m^3$.

Next, the cooled heat-treated toner particles are collected by a collection means 10 at the lower end of the treatment chamber. A blower (not shown) is provided at the end of the collection means and configured to ensure suction and transportation of the toner particles.

Further, a powder particle supply port 14 is provided such that the swirling direction of the supplied mixture and the swirling direction of the hot air are the same, and the collection means 10 of the surface treatment apparatus is provided on the outer periphery of the treatment chamber so as to maintain the swirling direction of the swirled powder particles. Furthermore, the cold air supplied from the cold air supply means 8 is supplied horizontally and tangentially from the outer peripheral portion of the apparatus to the peripheral surface of the treatment chamber.

The swirling direction of the toner particles supplied from the powder supply port, the swirling direction of the cold air supplied from the cold air supply means, and the swirling direction of the hot air supplied from the hot air supply means are all the same. Therefore, no turbulent flow occurs in the treatment chamber, the swirling flow in the apparatus is enhanced, strong centrifugal force is applied to the toner particles, and the dispersibility of the toner particles is further improved. As a result, toner particles including few coalesced particles and having uniform shape can be obtained.

When the average circularity of the toner is from 0.960 to 0.980, the non-electrostatic attraction force can be suppressed to a low level, which is preferable from the viewpoint of fogging suppression.

After that, classification may be performed if necessary. For example, ELBOW JET (manufactured by Nittetsu Mining Co., Ltd.) of an inertial jet type can be used. Desired amounts of the inorganic fine particles A and silica particles B are externally added to the surface of the classified heat-treated toner particles.

As a method of external addition treatment, a mixing device such as a double-cone mixer, a V-type mixer, a drum mixer, SUPER MIXER, a Henschel mixer, NAUTA mixer, MECHANO HYBRID (manufactured by Nippon Coke Industry Co., Ltd.), and NOBILTA (manufactured by Hosokawa Micron Corporation) is used as an external addition device and stirring and mixing are performed. At that time, if necessary, an external additive other than the inorganic fine particles A and the silica particles B, such as a fluidizing agent, may be externally added.

The toner of the present invention is not particularly limited, and can be applied to a known image forming method.

From the viewpoint of the effect of the present invention, it is preferable to use an image forming method having a charging step of bringing a charging member into contact with a photosensitive member to charge a surface of the photosensitive member;

an electrostatic latent image forming step of forming an electrostatic latent image on the charged photosensitive member; and a developing step of developing the electrostatic latent image with a toner to form a toner image.

Methods for measuring various physical properties of toner and raw materials will be described below.

Measurement of Peak Molecular Weight and Weight Average Molecular Weight of Resin etc.

The molecular weight distribution of the THF soluble matter of the resin is measured by gel permeation chromatography (GPC) in the following manner.

First, the sample is dissolved in tetrahydrofuran (THF) for 24 h at room temperature. Then, the resulting solution is filtered through a solvent-resistant membrane filter "MAESHORI DISK" (manufactured by Tosoh Corporation) having a pore diameter of 0.2 μm to obtain a sample solution. The sample solution is adjusted so that the concentration of the components soluble in THF is about 0.8% by mass. The measurement is performed under the following conditions by using this sample solution.

Device: HLC8120 GPC (detector: RI) (manufactured by Tosoh Corporation)

Column: 7 series of Shodex KF-801, 802, 803, 804, 805, 806, 807 (manufactured by Showa Denko K.K.)

Eluent: tetrahydrofuran (THF)

Flow rate: 1.0 ml/min

Oven temperature: 40.0° C.

Sample injection volume: 0.10 ml

When calculating the molecular weight of the sample, a molecular weight calibration curve prepared using a standard polystyrene resin (for example, trade name "TSK standard polystyrene F-850, F-450, F-288, F-128, F-80, F-40, F-20, F-10, F-4, F-2, F-1, A-5000, A-2500, A-1000, A-500", manufactured by Tosoh Corporation) is used.

Method for Measuring Softening Point of Resin etc.

The measurement of the softening point is carried out using a constant-load extrusion type capillary rheometer "Flow Characteristic Evaluation Apparatus Flow Tester CFT-500D" (manufactured by Shimadzu Corporation) according to the manual provided with the apparatus. In this apparatus, the temperature of the measurement sample filled in the cylinder is raised and the sample is melted while applying a constant load with a piston from the top of the measurement sample, the melted measurement sample is extruded from a die at the bottom of the cylinder, and a flow curve showing the relationship between the piston descent amount and temperature at this time can be obtained.

In the present invention, the "melting temperature in the ½ method" described in the manual provided with the "Flow Characteristic Evaluation Apparatus Flow Tester CFT-500D" is taken as the softening point. The melting temperature in the ½ method is calculated in the following manner. First, a half of the difference between the descent amount of Smax of the piston at the end of the outflow and the descent amount Smin of the piston at the start of the outflow is determined (this is taken as X. X=(Smax−Smin)/2). The temperature at the time the descent amount of the piston in the flow curve is the sum of X and Smin is the melting temperature in the ½ method.

The measurement sample is prepared by compression molding about 1.0 g of the resin into a cylinder with a diameter of about 8 mm at about 10 MPa for about 60 sec under an environment at 25° C. by using a tablet press (for example, NT-100H, manufactured by NPA Systems Inc.).

The measurement conditions of CFT-500D are as follows.

Test mode: temperature rising method

Starting temperature: 50° C.

Reached temperature: 200° C.

Measurement interval: 1.0° C.

Heating rate: 4.0° C./min

Piston cross-sectional area: 1.000 $cm^2$

Test load (piston load): 10.0 kgf (0.9807 MPa)

Preheating time: 300 sec

Die hole diameter: 1.0 mm

Die length: 1.0 mm

Measurement of Glass Transition Temperature (Tg) of Resin etc.

The glass transition temperature and the melting peak temperature are measured according to ASTM D3418-82 by using a differential scanning calorimeter "Q2000" (manufactured by TA Instruments).

The melting points of indium and zinc are used for temperature correction of the device detection unit, and the melting heat of indium is used for correction of heat quantity.

Specifically, measurements are performed under the following conditions by accurately weighing 3 mg of a sample, placing the sample in an aluminum pan, and using an empty aluminum pan as a reference.

Temperature rise rate: 10° C./min

Measurement start temperature: 30° C.

Measurement end temperature: 180° C.

The measurement is performed in a measurement range of 30° C. to 100° C. at a temperature rise rate of 10° C./min. The temperature is raised to 180° C. and held for 10 min, and then the temperature is lowered to 30° C., and thereafter the temperature is raised again. In the second temperature raising process, a change in specific heat is obtained in the temperature range of 30° C. to 100° C. The intersection point of the line at the midpoint between the baselines before and after the specific heat change at this time and the differential thermal curve is taken as a glass transition temperature (Tg).

Method for Measuring Average Circularity of Toner

The average circularity of the toner is measured with a flow-type particle image analyzer "FPIA-3000" (manufactured by Sysmex Corp.) under the same measurement and analysis conditions as at the time of calibration operation.

The principle of measurement with the flow-type particle image meter "FPIA-3000" (manufactured by Sysmex Corp.) is in capturing an image of a flowing particle as a static image and performing image analysis. The sample added to a sample chamber is taken by a sample suction syringe and fed to a flat sheath flow cell. The sample fed to the flat sheath flow forms a flat flow sandwiched by sheath fluid. The sample passing through the flat sheath flow cell is irradiated by stroboscopic light at intervals of 1/60 sec, and the image of the flowing particle can be captured as a static image. Further, since the flow is flat, focused images are captured. The image of a particle is captured by a CCD camera and the captured image is processed at an image processing resolution of 512×512 pixels (0.37 μm×0.37 μm per pixel) and a projected area S and a perimeter L of a particle image are measured by extracting the contour of each particle image.

Next, the circle-equivalent diameter and circularity are obtained by using the area S and perimeter L. The circle-equivalent diameter refers to the diameter of a circle having the same area as the projected area of a particle image. The circularity is defined as a value obtained by dividing the perimeter of the circle obtained based on the circle-equivalent diameter by the perimeter of the particle projection image and calculated by the following equation.

$$\text{Circularity}=2\times(\pi\times S)^{1/2}/L.$$

When a particle image is circular, the circularity is 1.000. As the degree of unevenness of the periphery of a particle image increases, the circularity decreases. After the circularity of each particle has been calculated, the range of circularity from 0.200 to 1.000 is divided into 800 portions and an arithmetic mean value of the obtained circularities is calculated and taken as the average circularity.

The specific measurement method is as follows.

Initially, about 20 mL of ion exchanged water from which solid impurities and the like have been removed in advance is placed in a glass container. Then, about 0.2 mL of a diluted solution prepared by diluting "CONTAMINON N" (a 10 mass % aqueous solution of a neutral detergent which has pH of 7 and used for washing precision measurement devices, the neutral detergent including a nonionic surfactant, an anionic surfactant, and an organic builder; manufactured by Wako Pure Chemical Industries, Ltd.) about 3 mass times with ion exchanged water is added as a dispersing agent thereto.

About 0.02 g of the measurement sample is then added, and dispersion treatment is performed for 2 min with an ultrasonic disperser to obtain a dispersion liquid for measurements. At that time, the dispersion liquid is suitably cooled such that the temperature thereof is from 10° C. to 40° C. A prescribed amount of ion exchanged water is placed in a water tank followed by the addition of about 2 mL of the CONTAMINON N to the water tank by using a desktop ultrasonic cleaner/disperser having an oscillation frequency of 50 kHz and an electrical output of 150 W ("VS-150" (manufactured by Velvo-Clear Co., Ltd.)) as the ultrasonic disperser.

During the measurements, the aforementioned flow particle image analyzer equipped with a standard objective lens (magnification factor: 10 times) is used, and the Particle Sheath "PSE-900A" (manufactured by Sysmex Corp.) is used for the sheath liquid. The dispersion liquid prepared in accordance with the aforementioned procedure is introduced into the flow particle image analyzer and 3000 toners are counted in the HPF measurement mode using the total count mode.

The average circularity of the toner is determined by setting the binarized threshold during particle analysis to 85% and limiting the analyzed particle diameter to a circle-equivalent diameter of from 1.98 μm to 39.69 μm.

In the course of the measurements, focus is adjusted automatically using standard latex particles prior to the start of the measurements ("RESEARCH AND TEST PARTICLES, Latex Microsphere Suspensions 5200A" manufactured by Duke Scientific Corp. and diluted with ion exchanged water). Subsequently, focus is preferably adjusted every 2 h after the start of the measurements.

Method for Measuring Number Average Particle Diameter of Inorganic Fine Particles A and Silica Particles B The number average particle diameter of the inorganic fine particles A and the silica particles B is calculated by capturing the image of a sample with a transmission electron microscope (TEM), counting 100 primary particles, and measuring the major diameter thereof. The particles with a particle diameter of 5 nm to 50 nm are observed at a magnification of 500,000, and those having a diameter of more than 50 nm to 500 nm are observed at a magnification of 50,000.

When Measuring from Toner

The measurement of the number average particle diameter of the inorganic fine particles A and the silica particles B coated on the toner is performed using a scanning electron microscope "S-4800" (trade name; manufactured by Hitachi, Ltd.). The toner to which the external additive has been externally added is observed, and the major diameter of the primary particles of 100 external additives is randomly measured to find the number average particle diameter (Dl) in a field of view magnified up to 200,000 times at maximum. The observation magnification is adjusted, as appropriate, according to the size of the external additive.

Separation of Inorganic Fine Particles A from Toner

The inorganic fine particles A can be separated from the external additive contained in the toner by the following method, and a rubbing test can also be performed.

In a toner in which a plurality of external additives is externally added to a toner particle, each external additive is isolated and recovered.

An example of a specific method is presented hereinbelow.

(1) A total of 5 g of the toner is placed in a sample bottle and 200 ml of methanol is added.

(2) The sample is dispersed for 5 min with an ultrasonic cleaner to separate the external additives.

(3) Suction filtration (10 μm membrane filter) is performed to separate the toner particles and the external additives.

(4) The above (2) and (3) are performed until a desired sample amount is obtained.

By the above operation, each externally added external additive is isolated from the toner particles. The recovered aqueous solution is centrifuged to separate and recover each external additive for each specific gravity. The rubbing test can then be carried out by removing the solvent and thoroughly drying in a vacuum dryer.

Measurement of Amount of Inorganic Fine Particles A and Silica Particles B in Toner When the amount of each external additive is measured in a toner in which a plurality of external additives has been externally added to toner particles, the external additives are removed from the toner particles, and further, a plurality of external additives is isolated and recovered.

Specific methods include, for example, the following methods.

(1) A total of 5 g of the toner is placed in a sample bottle and 200 ml of methanol is added.

(2) The sample is dispersed for 5 min with an ultrasonic cleaner to separate the external additives.

(3) Suction filtration (10 μm membrane filter) is performed to separate the toner particles and the external additives.

(4) The above (2) and (3) are performed until a desired sample amount is obtained.

By the above operation, the externally added external additives are isolated from the toner particles. The recovered aqueous solution is centrifuged to separate and recover each external additive for each specific gravity. Next, the solvent is removed, sufficient drying is performed with a vacuum dryer, and the mass is measured to obtain the amount of each external additive.

(Method for Isolating the Binder Resin)

The binder resin used for measuring the surface potential can be obtained by extracting the binder resin from the toner. The following method can be used for extracting the binder resin from the toner.

First, the toner is mixed with a solvent such as THF, and stirring under room temperature or heating condition to dissolve the binder resin. The insoluble matter contained in the obtained solution such as an external additive, a release agent, a charge control agent and a colorant (such as a pigment) is removed by centrifugation, filtration, washing and so on. When a component other than the binder resin is dissolved in the solvent, the binder resin can be isolated by using GPC equipped with isolation mechanism, high performance liquid chromatography (HPLC) and so on.

In addition, solvent removal is preferably conducted by solvent evaporation, and method for solvent evaporation exemplified by such as heating, decompression and ventilation.

EXAMPLES

Hereinafter, the present invention will be described in greater detail using Examples and Comparative Examples, but the embodiments of the present invention are not limited thereto. In the Examples and Comparative Examples, parts are based on mass unless specifically noted otherwise.

Binder Resin 1; Production Example of Polyester Resin

Polyoxypropylene (2.2)-2,2-bis(4-hydroxyphenyl)propane: 73.8 parts (0.19 mol; 100.0 mol % relative to the total number of moles of polyhydric alcohol)

Terephthalic acid: 12.5 parts (0.08 mol; 48.0 mol % relative to the total number of moles of polyvalent carboxylic acid)

Adipic acid: 7.8 parts (0.05 mol; 34.0 mol % relative to the total number of moles of polyvalent carboxylic acid)

Titanium tetrabutoxide (esterification catalyst): 0.5 parts

The above materials were weighed into a reaction vessel equipped with a condenser, a stirrer, a nitrogen introduction pipe, and a thermocouple. Next, after the inside of the flask was replaced with nitrogen gas, the temperature was gradually raised while stirring, and reaction was performed for 2 h while stirring at a temperature of 200° C.

Further, the pressure in the reaction vessel was lowered to 8.3 kPa and maintained for 1 h, followed by cooling to 160° C. and returning to atmospheric pressure (first reaction step).

Trimellitic acid: 5.9 parts (0.03 mol; 18.0 mol % relative to the total number of moles of polyvalent carboxylic acid)

Tert-butyl catechol (polymerization inhibitor): 0.1 part

Then, the above materials were added, the pressure in the reaction vessel was lowered to 8.3 kPa, and the reaction was carried out for 15 h while maintaining the temperature at 200° C. After it was confirmed that the softening point measured according to ASTM D36-86 reached a temperature of 120° C., the temperature was lowered to stop the reaction (second reaction step), and a binder resin 1 was obtained. The obtained binder resin 1 had a peak molecular weight Mp 10,000, a softening point Tm 110° C., and a glass transition temperature Tg 60° C.

Binder Resin 2; Production Example of Styrene Acrylic Resin

After replacing the atmosphere with nitrogen in an autoclave reactor equipped with a thermometer and a stirrer, a mixed solution of the following materials was added dropwise at 180° C. for 3 h for polymerization, and then kept at this temperature for 30 min.

Styrene 77.0 parts

Butyl acrylate 23.0 parts

Xylene 250 parts

Azobisisobutyronitrile 4 parts

Subsequently, the solvent was removed to obtain a binder resin 2.

Binder Resin 3; Production Example of Hybrid Resin

Bisphenol A ethylene oxide adduct (2.0 mol addition) 50.0 mol parts

Bisphenol A propylene oxide adduct (2.3 mol addition) 50.0 mol parts

Terephthalic acid 60.0 mol parts

Trimellitic anhydride 20.0 mol parts

Acrylic acid 10.0 mol parts

A total of 70 parts of the mixture of the above polyester monomers was charged in a four-necked flask, a pressure reducing device, a water separating device, a nitrogen gas introducing device, a temperature measuring device and a stirring device were mounted, and stirring was performed at 160° C. under a nitrogen atmosphere. A mixture of 30 parts of a vinyl-based polymer monomer (styrene: 90.0 mol parts, butyl acrylate: 10.0 mol parts) constituting a vinyl polymer segment and 2.0 mol parts of benzoyl peroxide as a polymerization initiator was dropwise added over 4 h from a funnel. Then, after reacting for 5 h at 160° C., the temperature was raised to 230° C., 0.05% by mass of tetraisobutyl titanate was added, and the reaction time was adjusted to obtain a desired viscosity.

After completion of the reaction, the reaction product was taken out of the vessel, cooled and pulverized to obtain a binder resin 3 which is a hybrid resin.

Production Example of Toner 1

Binder resin 1 100 parts

Fisher Tropsch wax (peak temperature of maximum endothermic peak 90° C.) 4 parts 3,5-Di-t-butylsalicylic acid aluminum compound (Bontron E 88, manufactured by Orient Chemical Industry Co., Ltd.) 0.3 part Carbon black 10 parts The above materials were mixed using a Henschel mixer (type FM-75, manufactured by Mitsui Mining Co., Ltd.) at a revolution speed of 1500 rpm for a rotational time of 5 min, and then kneaded with a twin-screw kneader (PCM-30 type, manufactured by in Ikegai Corp.) set to a temperature of 130° C. The obtained kneaded product was cooled and coarsely pulverized to 1 mm or less with a hammer mill to obtain a coarsely pulverized product. The obtained coarsely pulverized product was finely pulverized by a mechanical pulverizing device (T-250, manufactured by Turbo Kogyo Co., Ltd.). Further, classification was performed using FACULTY (F-300, manufactured by Hosokawa Micron Corporation) to obtain toner particles 1. The operating conditions were such that the classification rotor revolution speed was 11,000 rpm, and the dispersion rotor revolution speed was 7200 rpm.

The obtained toner particles 1 were heat-treated with a surface treatment apparatus shown in the FIGURE to obtain heat-treated toner particles. The operating condition were as follows: feed amount=5 kg/hr, hot air temperature=160° C., hot air flow rate=6 $m^3$/min, cold air temperature=−5° C., cold air flow=4 $m^3$/min, blower air flow rate=20 $m^3$/min, and injection air flow rate=1 $m^3$/min.

The heat-treated toner particles thus obtained were adjusted using ELBOW JET (manufactured by Nittetsu Mining Co., Ltd.) of inertial classification system to obtain the desired particle size distribution and center particle diameter under the operating conditions of feed amount=5 kg/hr, an F classification edge (fine particle classification edge) of 3 mm to 5 mm, and a G classification edge (coarse powder classification edge) being maximized and closed.

Heat-treated toner particles 100 parts

Silica fine particles (number average particle diameter 120 nm): fumed silica surface-treated with hexamethyldisilazane (silica powder is sprayed with water and hexamethyldisilazane and heat-treated at 150° C. to 250° C. in a nitrogen atmosphere) 2.5 parts Strontium titanate fine particles (number average particle diameter 35 nm): strontium titanate fine particles that were surface-treated (the magnetic material washed, filtered and dried was treated with a coupling agent) with a fluorine-containing silane coupling agent (3,3,3-trifluoropropyldimethoxysilane) 1.0 part The above materials were mixed with a Henschel mixer (type FM-75, manufactured by Mitsui Miike Machinery Co., Ltd.) at a revolution speed of 1900 rpm for 3 min to obtain toner 1.

Production Example of Toners 2 to 23

Toners 2 to 23 were obtained by performing the same operations as in the production example of the toner 1, except that the type of the binder resin, the addition sequence of the inorganic fine particles A and silica particles B, mixing condition (revolution speed and revolution time), the type, the number of added parts, the particle diameter, and the surface treatment of the inorganic fine particles A, and the particle diameter and the number of added parts of the silica particles B were changed as shown in Table 1. The physical properties are shown in Table 1.

TABLE 1

| | | | Inorganic fine particles A | | | | | | | | | | Silica particles B | | | | | |
|---|---|---|---|---|---|---|---|---|---|---|---|---|---|---|---|---|---|---|
| Toner No. | Binder resin No. | AS | Material | PD [nm] | Shape | Surface treatment | Surface potential difference C | YA | fixing ratio | Parts | RT [min] | RS [rpm] | PD [nm] | YB | Parts | RT [min] | RS [rpm] | YA/YB |
| 1 | 1 | A + B | ST | 35 | C | F | +50 V | 5.00 | 50% | 1.0 | 3.0 | 1900 | 120 | 3.50 | 2.5 | 3.0 | 1900 | 1.43 |
| 2 | 2 | A + B | ST | 35 | C | ZnS | −50 V | 4.80 | 52% | 1.0 | 3.0 | 1900 | 120 | 3.40 | 2.5 | 3.0 | 1900 | 1.41 |
| 3 | 3 | A + B | ST | 35 | C | F | +30 V | 4.90 | 51% | 1.0 | 3.0 | 1900 | 120 | 3.44 | 2.5 | 3.0 | 1900 | 1.42 |
| 4 | 1 | A → B | ST | 35 | C | F | +50 V | 4.95 | 67% | 1.5 | 3.0 | 1900 | 120 | 3.49 | 2.5 | 3.0 | 1900 | 1.42 |
| 5 | 1 | A → B | ST | 35 | C | F | +50 V | 5.20 | 48% | 1.0 | 2.0 | 1900 | 120 | 6.24 | 2.5 | 1.0 | 1900 | 0.83 |
| 6 | 1 | A → B | ST | 35 | C | F | +50 V | 5.40 | 46% | 1.0 | 2.0 | 1900 | 120 | 3.52 | 2.0 | 1.0 | 1900 | 1.53 |
| 7 | 1 | A → B | ST | 35 | C | F | +50 V | 4.80 | 52% | 1.0 | 3.0 | 1900 | 120 | 3.55 | 0.5 | 1.0 | 1200 | 3.30 |
| 8 | 1 | B → A | ST | 35 | C | F | +50 V | 4.70 | 53% | 1.0 | 3.0 | 1900 | 80 | 3.55 | 10.0 | 2.0 | 1900 | 1.32 |
| 9 | 1 | B → A | ST | 35 | C | F | +50 V | 4.70 | 53% | 1.0 | 3.0 | 1900 | 80 | 3.36 | 12.0 | 3.0 | 1900 | 1.40 |
| 10 | 1 | A + B | ST | 60 | C | F | +50 V | 4.70 | 53% | 1.0 | 3.0 | 1900 | 120 | 3.45 | 2.5 | 3.0 | 1900 | 1.36 |
| 11 | 1 | A + B | ST | 10 | C | F | +50 V | 4.80 | 52% | 1.0 | 3.0 | 1900 | 120 | 3.42 | 2.5 | 3.0 | 1900 | 1.40 |
| 12 | 1 | A + B | ST | 100 | C | F | +50 V | 5.20 | 48% | 1.0 | 3.0 | 1900 | 120 | 2.50 | 2.5 | 3.0 | 1900 | 2.08 |
| 13 | 1 | A + B | CaT | 75 | R | F | +50 V | 5.20 | 48% | 1.0 | 3.0 | 1900 | 120 | 3.21 | 2.5 | 3.0 | 1900 | 1.62 |
| 14 | 1 | A → B | ST | 35 | C | F | +50 V | 9.00 | 70% | 3.0 | 6.0 | 1900 | 120 | 4.18 | 2.5 | 3.0 | 1200 | 2.15 |
| 15 | 1 | B → A | ST | 35 | C | F | +50 V | 3.00 | 25% | 0.4 | 3.0 | 1200 | 120 | 0.70 | 2.5 | 3.0 | 1900 | 4.29 |
| 16 | 1 | A + B | ST | 35 | C | F | +50 V | 5.00 | 50% | 1.0 | 3.0 | 1900 | 80 | 3.55 | 2.5 | 3.0 | 1900 | 1.41 |
| 17 | 1 | A + B | ST | 35 | C | F | +50 V | 4.70 | 53% | 1.0 | 3.0 | 1900 | 200 | 3.46 | 2.5 | 3.0 | 1900 | 1.36 |
| 18 | 1 | A + B | ST | 35 | C | ZnS | +200 V | 4.80 | 52% | 1.0 | 3.0 | 1900 | 120 | 3.50 | 2.5 | 3.0 | 1900 | 1.37 |
| 19 | 1 | B → A | ST | 35 | C | F | +50 V | 8.00 | 20% | 1.0 | 3.0 | 500 | 120 | 3.52 | 2.5 | 3.0 | 1900 | 2.27 |
| 20 | 1 | A → B | ST | 35 | C | F | +50 V | 2.00 | 80% | 1.0 | 10.0 | 1900 | 120 | 3.45 | 2.5 | 3.0 | 1900 | 0.58 |
| 21 | 1 | A + B | ST | 35 | C | F | +50 V | 0.98 | 51% | 0.2 | 3.0 | 1900 | 120 | 3.38 | 2.5 | 3.0 | 1900 | 0.29 |
| 22 | 1 | A + B | ST | 35 | C | F | +50 V | 19.6 | 51% | 4.0 | 3.0 | 1900 | 120 | 3.66 | 2.5 | 3.0 | 1900 | 5.36 |
| 23 | 1 | A + B | ST | 80 | N | F | −50 V | 0.00 | 0% | 1.0 | 3.0 | 1900 | 120 | 3.65 | 2.5 | 3.0 | 1900 | — |

In the table, AS denotes "addition sequence", PD denotes "particle diameter", RT denotes "revolution time" and RS denotes "revolution speed". ST represents strontium titanate, and CaT represents calcium titanate. F represents a fluorine-containing silane coupling agent, and ZnS represents zinc stearate. C indicates a cube, R indicates a rectangular parallelepiped, N indicates a needle shape. The particle diameter is a number average particle diameter.

In the addition sequence, "A+B" indicates the method of adding simultaneously the inorganic fine particles A and the silica particles B, "A→B" indicates the method of adding the inorganic fine particles A at the first adding stage and then adding the silica particles B at the second adding stage, and "B→A" indicates the method of adding the silica particles B at the first adding stage and then adding the inorganic fine particles A at the second adding stage.

Production Example of Magnetic Core Particle 1

Step 1 (Weighing and Mixing Step):

| | |
|---|---|
| $Fe_2O_3$ | 62.7 parts |
| $MnCO_3$ | 29.5 parts |
| $Mg(OH)_2$ | 6.8 parts |
| $SrCO_3$ | 1.0 part |

Ferrite raw materials were weighed so as to obtain the above composition ratio of the abovementioned materials. Thereafter, the materials were pulverized and mixed for 5 h with a dry vibration mill using stainless steel beads having a diameter of ⅛ inch.

Step 2 (Pre-Baking Step):

The pulverized product obtained was made into about 1 mm square pellets with a roller compactor. This pellets were subjected to removal of coarse powder with a vibrating sieve having a mesh size of 3 mm, then fine powder was removed with a vibrating sieve having a mesh size of 0.5 mm, and pre-baked ferrite was prepared by baking at a temperature of 1000° C. for 4 h under a nitrogen atmosphere (oxygen concentration: 0.01% by volume) by using a burner-type baking furnace. The obtained pre-baked ferrite had the following composition.

$$(MnO)_a(MgO)_b(SrO)_c(Fe_2O_3)_d$$

In the above formula, a=0.257, b=0.117, c=0.007, and d=0.393.

Step 3 (Pulverization Step):

After pulverizing the pre-baked ferrite to about 0.3 mm with a crusher, 30 parts of water was added to 100 parts of the pre-baked ferrite and pulverization was carried out for 1 h by using a wet ball mill with zirconia beads having a diameter of ⅛ inch. The obtained slurry was pulverized with a wet ball mill using alumina beads having a diameter of 1/16 inch for 4 h to obtain a ferrite slurry (finely pulverized product of pre-baked ferrite).

Step 4 (Granulation Step):

A total of 1.0 part of ammonium polycarboxylate as a dispersing agent and 2.0 parts of polyvinyl alcohol as a binder were added, with respect to 100 parts of the pre-baked ferrite, to the ferrite slurry, followed by granulation into spherical particles with a spray drier (manufacturer: Ohkawara Kakohki Co., Ltd.). The obtained particles were adjusted in particle size and then heated at 650° C. for 2 h using a rotary kiln to remove organic components of the dispersing agent and the binder.

Step 5 (Baking Step):

In order to control the baking atmosphere, the temperature was raised in an electric furnace from room temperature to 1300° C. under a nitrogen atmosphere (oxygen concentration 1.00% by volume) in 2 h and then baking was carried out at a temperature of 1150° C. for 4 h. The temperature was then lowered to 60° C. over 4 h, the air atmosphere was restored from the nitrogen atmosphere, and the product was taken out at a temperature of 40° C. or lower.

Step 6 (Screening Step):

After disaggregating the aggregated particles, a low-magnetic-force product was cut by magnetic separation, and the coarse particles were removed by sieving with a sieve having a mesh size of 250 μm to obtain magnetic core particles 1 having a 50% particle diameter (D50) based on volume distribution of 37.0 μm.

Preparation of Coating Resin 1

Cyclohexyl methacrylate monomer 26.8% by mass

Methyl methacrylate monomer 0.2% by mass

Methyl methacrylate macromonomer 8.4% by mass (macromonomer having methacryloyl group at one end and a weight average molecular weight of 5000)

Toluene 31.3% by mass

Methyl ethyl ketone 31.3% by mass

Azobisisobutyronitrile 2.0% by mass

Of the above materials, cyclohexyl methacrylate monomer, methyl methacrylate monomer, methyl methacrylate macromonomer, toluene, and methyl ethyl ketone were placed in a four-necked separable flask equipped with a reflux condenser, a thermometer, a nitrogen introducing tube, and a stirrer. Nitrogen gas was introduced into the flask to obtain a sufficiently nitrogen atmosphere, followed by heating to 80° C. Thereafter, azobisisobutyronitrile was added and refluxing and polymerization were conducted for 5 h. Hexane was injected into the resulting reaction product to precipitate and deposit the copolymer, and the precipitate was filtered off and vacuum dried to obtain a coating resin 1.

A total of 30 parts of the coating resin 1 thus obtained was dissolved in 40 parts of toluene and 30 parts of methyl ethyl ketone to obtain a polymer solution 1 (solid fraction: 30% by mass).

Preparation of Coating Resin Solution 1

Polymer solution 1 (resin solid fraction concentration: 30% by mass) 33.3% by mass Toluene 66.4% by mass Carbon black (Regal 330; manufactured by Cabot Corporation) 0.3% by mass (primary particle diameter 25 nm, nitrogen adsorption specific surface area 94 $m^2/g$, DBP oil absorption amount 75 ml/100 g)

The abovementioned materials were dispersed for 1 h with a paint shaker using zirconia beads having a diameter of 0.5 mm. The resulting dispersion was filtered with a membrane filter of 5.0 μm to obtain a coating resin solution 1.

Production Example of Magnetic Carrier 1

Resin Coating Step:

The magnetic core particles 1 and the coating resin solution 1 were loaded into a vacuum degassing type kneader maintained at normal temperature (the loaded amount of the coating resin solution 1 was 2.5 parts as a resin component with respect to 100 parts of the magnetic core particles 1). After loading, the components were stirred at a revolution speed of 30 rpm for 15 min. After the solvent was volatilized to a certain extent (80% by mass) or more, the temperature was raised to 80° C. while mixing under reduced pressure, and toluene was distilled off over 2 h, followed by cooling. The obtained magnetic carrier was subjected to fractionation of a low-magnetic-force product by magnetic separation, sieving with a sieve having a mesh size of 70 μm, and classification with an air classifier to obtain a magnetic carrier 1 having a 50% particle diameter (D50) based on volume distribution of 38.2 μm.

Production Example of Two-Component Developer 1

A total of 92.0 parts of the magnetic carrier 1 and 8.0 parts of the toner 1 were mixed with a V-type mixer (V-20, manufactured by Seishin Enterprise Co., Ltd.) to obtain a two-component developer 1.

Production Examples of Two-Component Developers 2 to 23

Two-component developers 2 to 23 were obtained by performing the same operations as in the production example of the two-component type developer 1, except that changes shown in Table 2 were made.

TABLE 2

| Example | Two-component developer | Toner | Magnetic carrier |
|---|---|---|---|
| Example 1 | 1 | 1 | 1 |
| Example 2 | 2 | 2 | 1 |
| Example 3 | 3 | 3 | 1 |
| Example 4 | 4 | 4 | 1 |
| Example 5 | 5 | 5 | 1 |
| Example 6 | 6 | 6 | 1 |
| Example 7 | 7 | 7 | 1 |
| Example 8 | 8 | 8 | 1 |
| Example 9 | 9 | 9 | 1 |
| Example 10 | 10 | 10 | 1 |
| Example 11 | 11 | 11 | 1 |
| Example 12 | 12 | 12 | 1 |
| Example 13 | 13 | 13 | 1 |
| Example 14 | 14 | 14 | 1 |
| Example 15 | 15 | 15 | 1 |
| Example 16 | 16 | 16 | 1 |
| Example 17 | 17 | 17 | 1 |
| Comparative Example 1 | 18 | 18 | 1 |
| Comparative Example 2 | 19 | 19 | 1 |
| Comparative Example 3 | 20 | 20 | 1 |
| Comparative Example 4 | 21 | 21 | 1 |
| Comparative Example 5 | 22 | 22 | 1 |
| Comparative Example 6 | 23 | 23 | 1 |

Example 1

Evaluation described hereinbelow was performed using the two-component developer 1.

Transferability

Paper: GF-C081 (81.0 $g/m^2$) (Canon Marketing Japan Co., Ltd.); toner laid-on level in the solid image: 0.35 $mg/cm^2$ Primary transfer current: 30 μA Test environment: normal-temperature and normal-humidity environment (temperature 23° C./humidity 50% RH)

Process speed: 377 mm/sec

The two-component developer 1 was placed in a cyan developing device of the image forming apparatus and evaluated as described hereinbelow.

The toner remaining on the photosensitive member after the primary transfer and the toner before the primary transfer were individually taped off with a transparent polyester pressure-sensitive adhesive tape. The peeled pressure-sensitive adhesive tape was stuck on paper, and the concentration of the toner was measured by a spectral densitometer 500 series (X-Rite).

The rate of change of the concentration before the primary transfer and the concentration of transfer residue obtained as described above was taken as transfer efficiency, and evaluation was performed based on the following evaluation criteria. It was determined that the effect of the present invention was obtained at C or more.

A: transfer efficiency: 90% or more

B: transfer efficiency: 85% or more and less than 90%

C: transfer efficiency: 80% or more and less than 85%

D: transfer efficiency: less than 80%

Charging Roller Contamination

The evaluation was performed in an environment of temperature 23° C./humidity 50% RH (hereinafter referred to as "N/N environment") by using plain paper for color copiers and printers "GF-C081 (A4, 81.0 g/m$^2$)" (sold by Canon Marketing Japan Co., Ltd.) as the evaluation paper.

As a pattern image to be outputted, a pattern image 1 was used in which a strip-shaped solid part with a width of 2 mm and a strip-shaped white part with a width of 18 mm were repeatedly arranged in a direction parallel to the paper passing direction. At this time, the laid-on level of the toner on the paper in the solid portion in the pattern image 1 was 0.40 mg/cm$^2$.

After 100,000 prints of the pattern image 1 were outputted, the output was stopped, and then the pattern image 2 in which the entire surface of the sheet was a solid portion was outputted (the laid-on level of the toner in the solid portion was 0.40 mg/cm$^2$).

The image density was randomly measured at 20 locations on the full-surface solid image using an X-Rite color reflection densitometer ("500 series", manufactured by X-Rite), and the difference between the maximum value and the minimum value of image density (image density difference) was used to evaluate the contamination of the charging roller at the time when 100,000 sheets were outputted. It was determined that the effect of the present invention was obtained at C or more.

A: image density difference is less than 0.04

B: image density difference is 0.04 or more and less than 0.07

C: image density difference is 0.07 or more and less than 0.10

D: image density difference is 0.10 or more

Low-Temperature Fixability

An unfixed toner image (0.6 mg/cm$^2$) was formed on an image receiving paper (64 g/m$^2$) by using a commercially available full-color digital copier (CLC1100, manufactured by Canon Inc.).

The fixing unit removed from a commercially available full-color digital copying machine (imageRUNNER ADVANCE C5051, manufactured by Canon Inc.) was modified so that the fixing temperature could be adjusted, and a fixing test of the unfixed toner image was performed using this fixing unit.

The process speed was set to 246 mm/sec under normal temperature and normal humidity, and the condition when the unfixed toner image was fixed was visually evaluated.

A: fixing is possible at a temperature equal to or below 120° C.

B: fixing is possible at a temperature higher than 120° C. and equal to or below 140° C.

C: fixing is possible at a temperature higher than 140° C., or there is no temperature range in which fixing is possible Examples 2 to 17 and Comparative Examples 1 to 6

Evaluation was performed in the same manner as in Example 1 except that two-component developers 2 to 23 were used. The evaluation results are shown in Table 3.

TABLE 3

| | Transferability (%) | | Charging roller contamination | | Low-temperature fixability [° C.] | |
|---|---|---|---|---|---|---|
| Example | | Transfer efficiency | | Image density difference | | Fixation temperature |
| Example 1 | A | 98% | A | 0.01 | A | 117 |
| Example 2 | A | 97% | A | 0.01 | B | 138 |
| Example 3 | A | 97% | A | 0.01 | B | 133 |
| Example 4 | A | 99% | A | 0.02 | B | 123 |
| Example 5 | A | 96% | B | 0.05 | A | 116 |
| Example 6 | B | 88% | A | 0.02 | A | 117 |
| Example 7 | C | 83% | A | 0.01 | A | 115 |
| Example 8 | A | 97% | A | 0.01 | B | 130 |
| Example 9 | A | 98% | A | 0.01 | B | 137 |
| Example 10 | A | 95% | B | 0.06 | A | 119 |
| Example 11 | A | 96% | A | 0.02 | B | 123 |
| Example 12 | A | 93% | C | 0.08 | A | 120 |
| Example 13 | B | 86% | A | 0.01 | A | 118 |
| Example 14 | B | 89% | C | 0.09 | B | 122 |
| Example 15 | C | 83% | C | 0.09 | A | 117 |
| Example 16 | A | 94% | A | 0.02 | B | 122 |
| Example 17 | A | 96% | A | 0.01 | B | 123 |
| Comparative Example 1 | D | 73% | A | 0.01 | A | 117 |
| Comparative Example 2 | C | 82% | D | 0.11 | A | 116 |
| Comparative Example 3 | B | 88% | D | 0.17 | A | 120 |
| Comparative Example 4 | B | 86% | D | 0.16 | A | 116 |
| Comparative Example 5 | D | 78% | D | 0.16 | C | 146 |
| Comparative Example 6 | B | 89% | D | 0.19 | A | 117 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-156148, filed Aug. 23, 2018, which is hereby incorporated by reference herein in its entirety.

What is claimed is:

1. A toner comprising:

a toner particle including a polyester binder resin, and an inorganic fine particle A and a silica particle B;

particle A being surface-treated with a fluorine-containing silane coupling agent and having a rectangular parallelepiped particle shape;

particle A being contained in an amount of 0.3 to 3.0 parts by mass with respect to 100 parts by mass of the toner particle and having a fixing ratio to the toner particle of 25 to 70%; and primary particles of particle B having a number average particle diameter of 80 to 200 nm, wherein YA/YB>0.75 and YA is 3.00 to 18.0 where, when preparing a dispersion of the toner in an aqueous sucrose solution, and centrifuging the dispersion, YA (mg) is a separation amount of particle A per 1 g of toner and YB (mg) is a separation amount of particle B per 1 g of toner, and a surface potential difference C in a rubbing test performed using particle A and the binder resin is −70 V to +70 V, when C=(surface potential D of a resin piece of the binder resin measured in a state in which particle A adheres to the resin piece after rubbing the resin piece and particle A together)—(surface potential E measured using a resin piece of the binder resin obtained by removing particle A by air blow after rubbing the resin piece and particle A together).

2. The toner according to claim 1, wherein particle A includes a strontium titanate particle.

3. The toner according to claim 1, wherein particle A has a number average particle diameter of 10 to 60 nm.

4. The toner according to claim 1, wherein particle B is contained in an amount of 0.5 to 10.0 parts by mass with respect to 100 parts by mass of the toner particle.

5. The toner according to claim 1, wherein particle B is contained in an amount of 2.0 to 10.0 parts by mass with respect to 100 parts by mass of the toner particle.

6. The toner according to claim 1, wherein YA/YB>1.20.

7. An image forming method comprising the steps of:

a charging step of bringing a charging member into contact with a photosensitive member to charge a surface of the photosensitive member;

an electrostatic latent image forming step of forming an electrostatic latent image on the charged photosensitive member; and a developing step of developing the electrostatic latent image with the toner according to claim 1 to form a toner image.

8. A toner comprising:

a toner particle including a binder resin, and an inorganic fine particle A and a silica particle B, the binder resin being a hybrid resin in which a polyester resin and a styrene—(meth)acrylic copolymer resin are bonded together;

particle A being surface-treated with a fluorine-containing silane coupling agent and having a rectangular parallelepiped particle shape;

particle A being contained in an amount of 0.3 to 3.0 parts by mass with respect to 100 parts by mass of the toner particle and having a fixing ratio to the toner particle of 25 to 70%; and primary particles of particle B having a number average particle diameter of 80 to 200 nm, wherein YA/YB>0.75 and YA is 3.00 to 18.0 where, when preparing a dispersion of the toner in an aqueous sucrose solution, and centrifuging the dispersion, YA (mg) is a separation amount of particle A per 1 g of toner and YB (mg) is a separation amount of particle B per 1 g of toner, and a surface potential difference C in a rubbing test performed using particle A and the binder resin is −70 V to +70 V when C=(surface potential D of a resin piece of the binder resin measured in a state in which particle A adheres to the resin piece after rubbing the resin piece and particle A together)—(surface potential E measured using a resin piece of the binder resin obtained by removing particle A by air blow after rubbing the resin piece and particle A together).

* * * * *